United States Patent [19]

Vertenten et al.

[11] Patent Number: 4,537,455

[45] Date of Patent: Aug. 27, 1985

[54] ELECTRICAL CONNECTOR

[75] Inventors: Edward Vertenten, Oostkamp, Belgium; Josef Heft, Munich, Fed. Rep. of Germany

[73] Assignee: Siemens Aktiengesellschaft, Berlin & Munich, Fed. Rep. of Germany

[21] Appl. No.: 478,531

[22] Filed: Mar. 24, 1983

[30] Foreign Application Priority Data

Mar. 25, 1982 [DE] Fed. Rep. of Germany ... 8208576[U]

[51] Int. Cl.[3] ..... H01R 11/20

[52] U.S. Cl. ..... 339/99 R

[58] Field of Search ..... 339/47 R, 97 P, 98, 339/99 R

[56] References Cited

U.S. PATENT DOCUMENTS 4,153,325 5/1979 Asick ..... 339/99 R
4,327,956 5/1982 Sitzler ..... 339/97 R
4,344,665 8/1982 Racilla et al. ..... 339/99 R
4,460,229 7/1984 Matthews ..... 339/99 R

*Primary Examiner*—Gil Weidenfeld
*Assistant Examiner*—Paula A. Austin
*Attorney, Agent, or Firm*—Hill, Van Santen, Steadman & Simpson

[57] ABSTRACT

The invention relates to an apparatus providing a means for the connection of filamentary or stranded wire electrical conductors to contact members such as cut-clamp elements extending from a printed circuit board, which apparatus accommodates a conductor transversely to its normal running direction in a detent slot open on one side, and in which the contact members are arranged on a base plate; a cover plate connectable with the base plate is provided in order to press a portion of a conductor line running between the base plate and cover plate into a detent slot and to maintain it in the pressed-in state between the base and cover plates.

6 Claims, 4 Drawing Figures

ELECTRICAL CONNECTOR

FIELD OF THE INVENTION

The invention relates to an apparatus for interconnecting individual filamentary or stranded wire electrical conductors to electrical contact members protruding from a fixed base plate.

PRIOR ART

Apparatus such as that disclosed in German OS No. 25 37 421 makes it possible to connect individual conductors of a ribbon cable to printed conductors of a printed circuit board. For this purpose the base plate of the apparatus in which the contact members are mounted is soldered with bores of the printed circuit board. To make this, generally pin shaped attachments of these contact members project from the base plate on the side thereof facing away from the cover plate and are soldered in these bores of the printed circuit board. The ribbon cable itself is inserted in the device between the base and cover plates in such a way that the individual conductors of the ribbon cable by means of channeling or rifling of the cover plate (matched to the wavy structure of the cable as viewed in cross-section) are adjusted to the contact members. By pressing the cover plate on to the base plate, the individual conductors of the ribbon cable are then pressed into the contacting slots of the cut-clamp contact members, whereby the tips of the cut-clamp contact members, are accommodated in mating recesses provided in the cover plate. Detent means of one form or another are arranged on the transverse edges of the base and cover plate to maintain them in fixed relation relative to one another.

Such an arrangement has not proven entirely satisfactory, however, since it is frequently desired to connect individual wires which are, for example, the individual conductors of a ribbon cable separated from that cable, with certain contact members fixed in a base plate. This is not readily possible with a prior art device such as that disclosed above with the aid of a cover plate matched to a ribbon cable, since in the case of separate individual wires, no alignment of the individual wires with the cover plate is present as is the case with a ribbon cable.

SUMMARY OF THE INVENTION

It is an object of the present invention to provide an apparatus of the type generally described above wherein, in an uncomplicated fashion, a large number of separate individual wires can be electrically connected to the contact members (which may be cut-clamp contacts) fixed in a base plate.

More particularly, the invention relates to a means for connecting a large number of filamentary or standard conductors to contact members positioned in a base plate. This is accomplished by means of a cover plate having two generally parallel rows of openings through which the filamentary or stranded conductors may be inserted. After passing through the openings, the conductors are then positioned inside the retaining sections of slots formed transversely to the longitudinal edges of the cover plate and associated with an opening in a row of openings adjacent the respective longitudinal edge.

A corresponding base plate having insulation piercing contact members (cut-clamp contacts) is aligned with the stranded or filamentary conductors and the cover plate to form a complete electrical connection apparatus. The base plate and the cover plate are secured together by means of two stage locking arrangement consisting in the first stage of detent means positioned on the transverse side of the cover plate. The second stage of the locking arrangement consists of compressing the cover plate and base plate together so as to form a complete electrical connection apparatus.

An additional feature of this invention is that the user is able to interconnect two random contact members of the device. This is accomplished by inserting one end of a conductor through the opening corresponding to one contact member, while the other end of the same conductor is inserted through the opening of the other contact member. In this manner, all of the contact members of this device can be randomly interconnected in pairs.

DESCRIPTION OF THE PREFERRED EMBODIMENT

Figure 1:
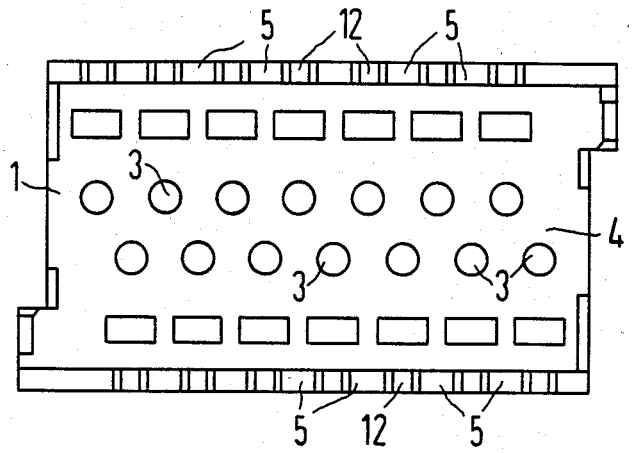
FIG. 1 is a side elevational view of a cover plate of the subject apparatus taken from that side of the cover plate adapted for the purpose of facing a mating base plate.
Figure 2:
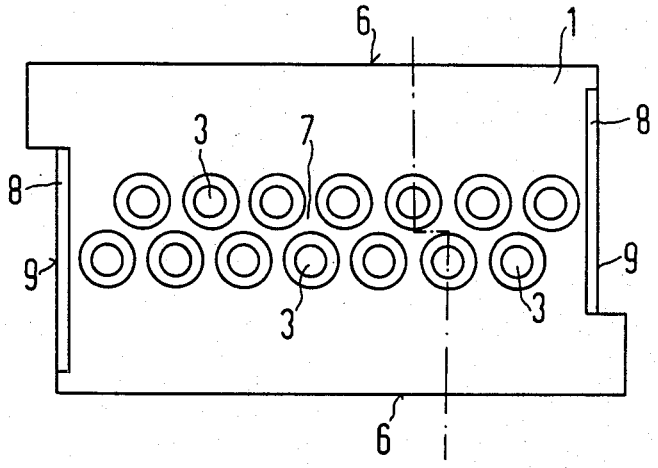
FIG. 2 is a side elevational view of the cover plate shown in FIG. 1 but taken on the opposite side thereof.

Referring to the drawings, a cover plate is therein shown which is designated with the reference numeral 1 and which is adapted to be affixed to and mate with a corresponding base plate (element 1*a* in FIG. 3) having cut-clamp contact members 1*b* extending therefrom which, in turn, may, for example, be connected to the printed conductors 1*c* of a printed circuit board 1*d*. The cover plate 1 has a series of symmetrical openings 3 formed in the face thereof which are aligned in two parallel rows and are offset from one another. The longitudinal edges 6 of the cover plate 1 extend from the surface thereof in one direction and are adapted to fit over the corresponding edges of the mating base plate 1*a* in a well known fashion. The openings 3 are adapted to receive individual insulated conductors which extend through the surface of the cover plate and which are adapted to be placed in electrical contact with contact elements carried by the mating base plate.

Figure 3:
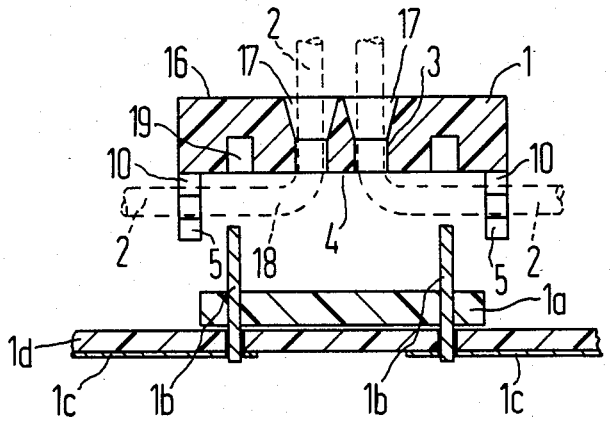
FIG. 3 is a vertical sectional view through the cover plate of FIGS. 1 and 2 and taken along lines III—III of FIG. 2; and showing in schematic fashion a base plate with its associated cut-clamp contactors.
Figure 4:
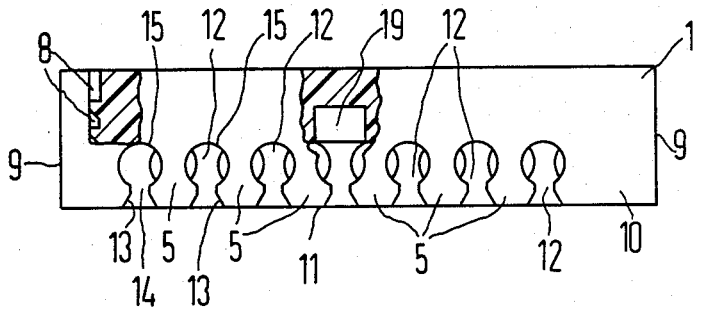
FIG. 4 is a plan view of the cover plate of FIG. 1.

As shown particularly in FIG. 3, filamentary or stranded conductors 2 having an insulating cover or sheath can be guided through the cover plate 1 from the surface 16 thereof (on the outside of the cover plate) toward the inside surface thereof. In order to facilitate the insertion of the conductors 2 into and through the openings 3, the openings are formed in funnel shape configuration in a manner converged toward the inside surface of the cover plate with the largest diameter area of the funnel shaped opening being formed at the outside surface 16 of that plate.

Laterally projecting walls 10 extend at right angles from the inner surface of the cover plate 1 and these walls have a plurality of detent slots 12 formed therein. These detent slots are formed with a relatively wide mouth 13 along the outermost edges of the walls and converge in to restricted throats and then open again to larger diameter slot areas 15 adapted to contain individual insulated or sheathed electrical conductors. The relative dimensions of these various portions of the detent slots are such that an insulated conductor is effectively forced through the restricted throat 14 and is then releasably engaged within the larger diameter slot area 15. The detent slots are effectively separated by a series of retaining members 5 formed along the edges 6 of the inside surface 4 of the cover plate which faces the base plate.

The conductor 2, held in a generally fixed position by passage through the opening 3 on the one hand, and by the slot 12, on the other hand, has an extended portion 18 which runs generally parallel to the transverse edge of the cover plate 1. The portion 18 bridges a recess 19 formed in the cover plate 1 which is provided for the purpose of accommodating the legs of the insulation piercing contact formed on the base plate. The portion 18 is thus aligned to the corresponding contacting slots formed on the insulation piercing contacts 1*b* of the base plate 1*a*. The alignment of the conductor portion 18 to the detent slot can be reinforced by means of conducting projections (not illustrated) which project from a side 4 of the cover plate 1 and act on the portion 18.

A two stage locking means of the cover plate 1 to the base plate 1*a*, as is known from the German OS No. 25 37 421, is provided by detent means 8 positioned on the transverse sides 9 of the cover plate 1. In the first stage, the distance between the cover plate 1 and the base plate is sufficiently larger to enable the user to examine the position of the conductor portions 18 vis-a-vis the individual contact members on the base plate before the cover plate 1 and the base plate are pressed against one another to achieve the locked position in the second stage. In the second stage, the conductor portions 18 of the individual conductors 2 are compressed into the detent slots of the contact members on the base plate. The walls 10 partially enclose the base plate.

An important feature of the invention is the ability to interconnect two random contact members on the device. To achieve this feature, one end of the conductor 2 is inserted through the opening 3 associated with a particular contact member, and the other end of the same conductor 2 is then inserted through the opening 3 associated with the other contact member. The two ends of the conductor 2 on the side 4 of the cover plate 1 are fixed in the corresponding slots 12, after which, the cover plate 1 is locked together with the base plate. In this manner, all of the contact members of the device can be randomly interconnected in pairs since the conductors 2 on the side 4 of the cover plate can readily intersect.

Although modifications and changes may be suggested by those skilled in the art, it is the intention of the inventor to embody within the patent warranted hereon all changes and modifications as reasonably and properly come within the scope of his contribution to the art.

What is claimed:

1. A connector for connection of insulated filamentary or stranded individual electrical conductors with cut-clamp electric contact members carried on a base plate, which comprises:

a cover plate having a face adapted to lie in juxtaposition to a face of said base plate and to sandwich portions of said conductors between said plate faces;

multiple through-passage openings extending through said cover plate in a direction of the face of said base plate, sized to receive individual insulated electrical conductors and disposed in a strip-shaped central region of said cover plate, wherein said strip-shaped central region of said cover plate extends parallel to at least one longitudinal edge of said cover plate;

opposite longitudinal edges of said cover plate each having a wall extending from the face of said cover plate in the direction of said base plate, each wall including retaining members disposed intermediate a plurality of detent slots, said detent slots being open to an edge of the respective wall and being adapted to retain individual conductors in substantially parallel relation to said face of said cover plate so that when a conductor is inserted through said openings and retained by said retaining member, it is contactable by a cut-clamp contact carried by said base plate in a region of said conductor sandwiched between said plate;

said through-passage openings being arranged in two rows which are parallel to longitudinal edges of said cover plate and the retaining members on one wall being associated with the one row and the retaining members on the opposite wall being associated with the other row;

mating detent means on said cover and base plates for releasably locking the plates together; and at least one electric conductor having its two ends inserted through two of said through-passage openings in said cover plate and having two end portions thereof sandwiched between said cover and base plates with its two ends contained within separate detent slots.

2. A connector constructed in accordance with claim 1, wherein said open ended slots are provided with a restricted throat so as to releasably retain insulated conductors within said slots.

3. A connector constructed in accordance with claim 1 wherein said through-passage openings on the side of said cover plate facing away from said base plate are expanded in funnel-shaped fashion towards the exterior.

4. A connector constructed in accordance with claim 1, wherein said through-passage openings are arranged in two rows which are parallel to the longitudinal edges of said cover plate and that the retaining members are formed on both longitudinal edges of said cover plate and that the retaining members one one longitudinal edge thereof are associated with that one row and that the retaining members on the opposite longitudinal edge thereof are associated with the other row.

5. A connector constructed in accordance with claim 1, wherein at least one electric conductor has its two ends inserted through two through-passage openings in said cover plate and has two end portions thereof sandwiched between said cover and base plates with its two ends contained within separate detent slots.

6. A connector system for connection of insulated electrical conductors, comprising:

a planar base plate having a plurality of cut-clamp electric contact members extending perpendicularly therefrom and electrical conductors connecting to the cut-clamp electric contact members at a base of the contact members at the base plate;

a cover plate having a planar face adapted to lie in juxtaposition to a planar face of said base plate and to press against portions of said conductors between said planar faces when said cover plate is mated to said base plate;

a plurality of circular apertures arranged in two rows in the cover plate running perpendicular to said planar face and sized to receive the individual insulated conductors;

parallel with said rows lateral wall extensions protruding perpendicularly from said planar face of the cover plate at both sides thereof so as to overlap corresponding sides of the base plate;

each of said protruding walls having a plurality of insertion slots;

a plurality of recesses respectively disposed between the lateral wall and corresponding apertures of each of the rows at both sides of the cover plate, said recesses extending inwardly into the cover plate substantially perpendicularly to the planar face;

the detent slots being positioned so as to align the insulating conductor passing through a corresponding aperture such that the insulating conductor is bent over the corresponding recess and passes through the corresponding detent slot; and the cut-clamp contact members being respectively positioned to have the cutting ends thereof slice through the insulation of the conductors and pass into the corresponding recesses when the planar face of the base plate and the planar face of the cover plate compress the insulated conductors when the cover plate and the base plate are mated.

* * * * *